US007269475B1

(12) United States Patent
Hogg et al.

(10) Patent No.: US 7,269,475 B1
(45) **Date of Patent: *Sep. 11, 2007**

(54) DISTRIBUTED CONTROL SYSTEM WITH GLOBAL CONTRAINTS FOR CONTROLLING OBJECT MOTION WITH SMART MATTER

(75) Inventors: Tad H. Hogg, Mountain View, CA (US); Bjorn R. Carlson, Mountain View, CA (US); Vineet Gupta, Palo Alto, CA (US); Andrew A. Berlin, San Jose, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/033,222

(22) Filed: Mar. 2, 1998

(51) Int. Cl.
*G06F 7/00* (2006.01)

(52) U.S. Cl. ..... 700/229; 230/2; 230/8; 230/9; 230/13; 230/19; 230/20; 230/302; 406/19; 406/88; 406/89; 406/192; 414/676; 414/903

(58) Field of Classification Search ..... 700/2, 700/229, 230, 8, 13, 9, 19, 20, 11, 302; 198/358, 198/371.2, 502.1, 502.3; 406/19, 20, 88, 406/89, 192; 414/676, 903, 438
See application file for complete search history.

(56) References Cited

U.S. PATENT DOCUMENTS 4,910,691 A * 3/1990 Skeirik ..... 700/266
5,383,116 A * 1/1995 Lennartsson ..... 700/9
5,431,182 A * 7/1995 Brown ..... 137/487.5
5,548,597 A * 8/1996 Kayama et al. ..... 714/30
5,553,003 A * 9/1996 Harada et al. ..... 700/22
5,559,690 A * 9/1996 Keeler et al. ..... 364/164
5,634,636 A 6/1997 Jackson et al. ..... 271/225

(Continued)

FOREIGN PATENT DOCUMENTS

JP 406253374 A * 9/1994

(Continued)

OTHER PUBLICATIONS

Hattori et al, "Decentralized Control for Distributed Micro Actuators", Dec. 1996, IEEE 35th Conf. on Dec. and Control.*

(Continued)

*Primary Examiner*—Gene O. Crawford
*Assistant Examiner*—Jeffrey A. Shapiro

(57) ABSTRACT

Embedded in a transport assembly are arrays of microelectromechanical sensors and actuators for detecting and propelling an object. A controller having defined therein local computational agents and a global controller controls the array of sensors and actuators. The global controller provides global operating constraints to the local computational agents. The global operating constraints are developed using an approximate specification of system behavior based on simplified assumptions of an idealized system as well as limited sensor information aggregated from the array of sensors. The local computational agents compute a desired local actuator response using sensor information from a localized grouping of sensor units. To improve the accuracy of the global operating constraints, the local computational agents reduce differences between a global actuator response, computed using the global operating constraints, and the desired local actuator response. In addition, the local computational agents reduce the correlation among different parts of the transport assembly by reducing differences between actuator responses of neighborhoods of local computational agents.

20 Claims, 8 Drawing Sheets

U.S. PATENT DOCUMENTS

| | | | | | |
|---|---|---|---|---|---|
| 5,708,968 | A | * | 1/1998 | Suzuki | 455/34.1 |
| 5,812,394 | A | * | 9/1998 | Lewis et al. | 345/846 |
| 5,839,722 | A | * | 11/1998 | Berlin et al. | 271/265.02 |
| 5,963,212 | A | * | 10/1999 | Bakalash | 345/424 |
| 5,963,447 | A | * | 10/1999 | Kohn et al. | 700/181 |
| 6,027,112 | A | * | 2/2000 | Guenther et al. | 271/194 |
| 6,039,316 | A | * | 3/2000 | Jackson et al. | 271/194 |
| 6,119,052 | A | * | 9/2000 | Guenther et al. | 700/228 |
| 6,120,604 | A | * | 9/2000 | Hawkins | 118/300 |
| 6,201,996 | B1 | * | 3/2001 | Crater et al. | 700/69 |
| 6,240,335 | B1 | * | 5/2001 | Wehrung et al. | 198/571 |
| 6,266,694 | B1 | * | 7/2001 | Duguay et al. | 709/223 |

FOREIGN PATENT DOCUMENTS

JP 410289255 A * 10/1998

OTHER PUBLICATIONS

Fujita et al, "Measurements and Analysis on Characteristics of a Conveyor System Using Air Levitation", 1997, IEEE 6th Int'l Conf. on Emerg. Tech. And Fact. Aut. Proc.* van den Berg et al, "Modular Concept for Fluid Handling Systems", 1996, IEEE, MESA Res. Inst., Univ. of Twente, P.O. Box 217, 7500 AE Enschede, the Netherlands.*

Fujita et al, "Two-Dimensional Conveyance System using Cooperative Motions of Many Microactuators", 1996, IEEE, Inst. of Ind. Science, Univ. of Tokyo.*

Fujita et al, "Two Dimensional Micro Conveyance System with Through Holes for Electrical and Fluidic Interconnection", IEEE, Inst. of Ind. Science, Univ. of Tokyo.*

Fujita, "A Decade of MEMS and its Future" 1997, IEEE, Inst. of Ind. Science, Univ. of Tokyo.*

MacDonald et al, Single-Crystal Silicon Actuator Arrays for Micro Manipulation Tasks, 1996, IEEE, Cornell Univ., Ithaca, NY, 14853.*

Fujita et al, "A Conveyance System Using Air Flow Based on the Concept of Distributed Micro Motion Systems", Jun. 1994, IEEE, Journal of Microelectromechanical Systems, Vol. 3., No. 2.*

Karl F. Böhringer, Bruce R. Donald, Noel C. MacDonald, Gregory T.A. Kovacs and John W. Suh, "*Computational Methods for Design and Control of MEMS Micromanipulator Arrays,*" Computational Science & Engineering, pp. 17-29, Jan.-Mar. 1997.

Bjorn Carlson, Vineet Gupta, and Tad Hogg, "*Controlling Agents in Smart Matter with Global Constraints,*" Proc. of the AAA197 Workshop on Constraints and Agents, pp. 58-63, Jul. 1997 (also on the internet at http://ic-www.arc.nasa.gov/ic/people/vgupta/publications/smartmatter-aaai97.ps).

Murilo G. Coutinho and Peter M. Will, "*Using Dynamic Vector Force Fields to Manipulate Parts on an Intelligent Motion Surface,*" IEEE International Symposium on Assembly and Task Planning, Marina del Rey, CA, Aug. 1997.

Ilzuka, T.; Fujita, H., "Precise positioning of a micro conveyor based on superconductingmagnetic levitation", Proceedings of the 1997 International Symposium on Micromechatronics and Human Science, vol., Issue, pp. 131-135, 1997.

Fujita, H.; Konishi, S.; Furuhata, T.; Takeshima, N., "A Proposal for a Conveyance System with Parallel Cooperative Micro Modules", IEEE International Workshop on Emerging Technologies and Factory Automation, pp. 656-660, Aug. 11-14, 1992.

* cited by examiner

| AREA | POTENTIAL (V) |
|---|---|
| $A_1$ | $V_1$ |
| $A_2$ | $V_2$ |
| $A_3$ | $V_3$ |
| • | • |
| • | • |
| • | • |
| $A_n$ | $V_n$ |

1000

FIG. 10

DISTRIBUTED CONTROL SYSTEM WITH GLOBAL CONTRAINTS FOR CONTROLLING OBJECT MOTION WITH SMART MATTER

CROSS-REFERENCE TO RELATED APPLICATIONS

Cross-reference is made to the following U.S. patents, each of which is assigned to the same assignee as the present invention and hereby incorporated by reference: U.S. Pat. No. 6,039,316, entitled "Multi-Hierarchical Control System For Controlling Object Motion With Smart Matter"; U.S. Pat. No. 6,119,052 entitled "Market-Based Control System For Controlling Object Motion With Smart Matter"; and U.S. Pat. No. 6,027,112 entitled "Adaptive Multiagent Control System For Controlling Object Motion With Smart Matter".

BACKGROUND OF THE INVENTION

1. Field of the Invention

The present invention relates generally to a method and apparatus for controlling microelectromechanical systems (MEMS), and more particularly, to a control system having a global controller and local agents for controlling movement of an object on a transport assembly.

2. Description of Related Art

Smart matter is defined herein as a physical system or material with arrays of microelectromechanical devices embedded therein for detecting and adjusting to changes in their environment. For example, smart matter can be used to move sheets of paper in a printing machine or maneuver an aircraft by performing tiny adjustments to wing surfaces. Generally, each microelectromechanical device embedded in smart matter contains microscopic sensors, actuators, and controllers. A characteristic of smart matter is that the physical system consists large numbers (possibly thousands) of microelectromechanical devices. These devices work together to deliver a desired higher level function (e.g., moving a piece of paper from one location to another, or flying a plane).

Programs for controlling smart matter do not always adequately achieve the desired higher level function of issuing command to compensate for detected changes in a physical system because of the significant number of devices that operate in parallel to control it. That is, there exists a number of factors which make the computational task of a control program for smart matter difficult. One factor which may be cause control programs to be computationally intense is caused by the high redundancy of sensors and actuators in the physical material. In order for smart matter systems to exhibit the enhanced reliability and robustness over conventional systems, smart matter systems contain many more devices than necessary to achieve a desired performance. Failure or improper function of some elements, even a significant fraction, is compensated by the actions of the redundant components. Moreover, the ability of smart matter systems to tolerate component failure can be used beneficially to lower the fabrication cost of the components.

One approach for controlling smart matter is to rely on a single global processor coupled with rapid access to the full state of the system and detailed knowledge of system behavior. This method, however, is generally ineffective because of the large number of devices embedded in smart matter. Another approach for controlling smart matter is through the use of a collection of autonomous computational agents (or elements) that use sensor information to determine appropriate actuator forces. Using multiple computational agents to provide distributed control instead of centralized control may prove more effective because each computational agent is only concerned with limited aspects of the overall control problem. In some multi-agent systems, individual agents are associated with a specific sensor or actuator embedded in the physical system. This method for controlling smart matter defines a community of computational agents which, in their interactions, strategies, and competition for resources, resembles natural ecosystems. Furthermore, by distributing control among computational agents, the system as a whole is better able to adapt to environmental changes or disturbances because the system can compensate for new circumstances by simply changing the relationship of the agents.

Although multi-agent control systems have been used to solve distributed control problems, they have been limited to systems which are physically large or geographically scattered. For example, multi-agent systems have been used in distributed traffic control, flexible manufacturing, robotic system design, and self-assembly structures. Using multi-agent systems to control smart matter is different from these known multi-agent systems because of the tight coupling between computational agents and their embedded physical space. Furthermore, controlling smart matter using traditional multi-agent systems is difficult because of mechanical interactions that decrease in strength with the physical distance between them. This makes the computational problem difficult because interactions between computational agents cannot be ignored.

In defining a multi-agent control systems for controlling smart matter, there exits a need to identify a distributed control organization with agents that interact locally while robustly performing a global goal that is specified using global constraints on the system. It would, therefore, be desirable to provide a control system for controlling smart matter that is capable of rapidly responding to local perturbations while robustly satisfying the global goal. In addition, it would be desirable to provide a controller for smart matter that robustly coordinates a physically distributed real-time response with many devices in the face of failures, delays, changing environmental conditions, and incomplete models of system behavior.

SUMMARY OF THE INVENTION

In accordance with the invention there is provided a transport assembly, and method therefor, for moving an object. Sensor units and actuator units are arranged on the transport assembly. The sensor units provide positional information of the object. The actuator units move the object relative to the transport assembly. Local computational agents are coupled the sensor units and the actuator units. Each of the computational agents accumulates sensor information from a spatially localized grouping of sensor units. A global controller, coupled to the local computational agents, receives aggregate operating characteristics from, and delivers global constraints to, the local computational agents. The local computational agents use the global constraints and the sensor information to determine adjustments to the actuator units to move the object along the transport assembly.

BRIEF DESCRIPTION OF THE DRAWINGS

These and other aspects of the invention will become apparent from the following description read in conjunction with the accompanying drawings wherein the same reference numerals have been applied to like parts and in which:

FIG. 10 illustrates a lookup table for implementing the potential field shown in FIG. 6.

DETAILED DESCRIPTION

A. Transport Assembly

Figure 1:
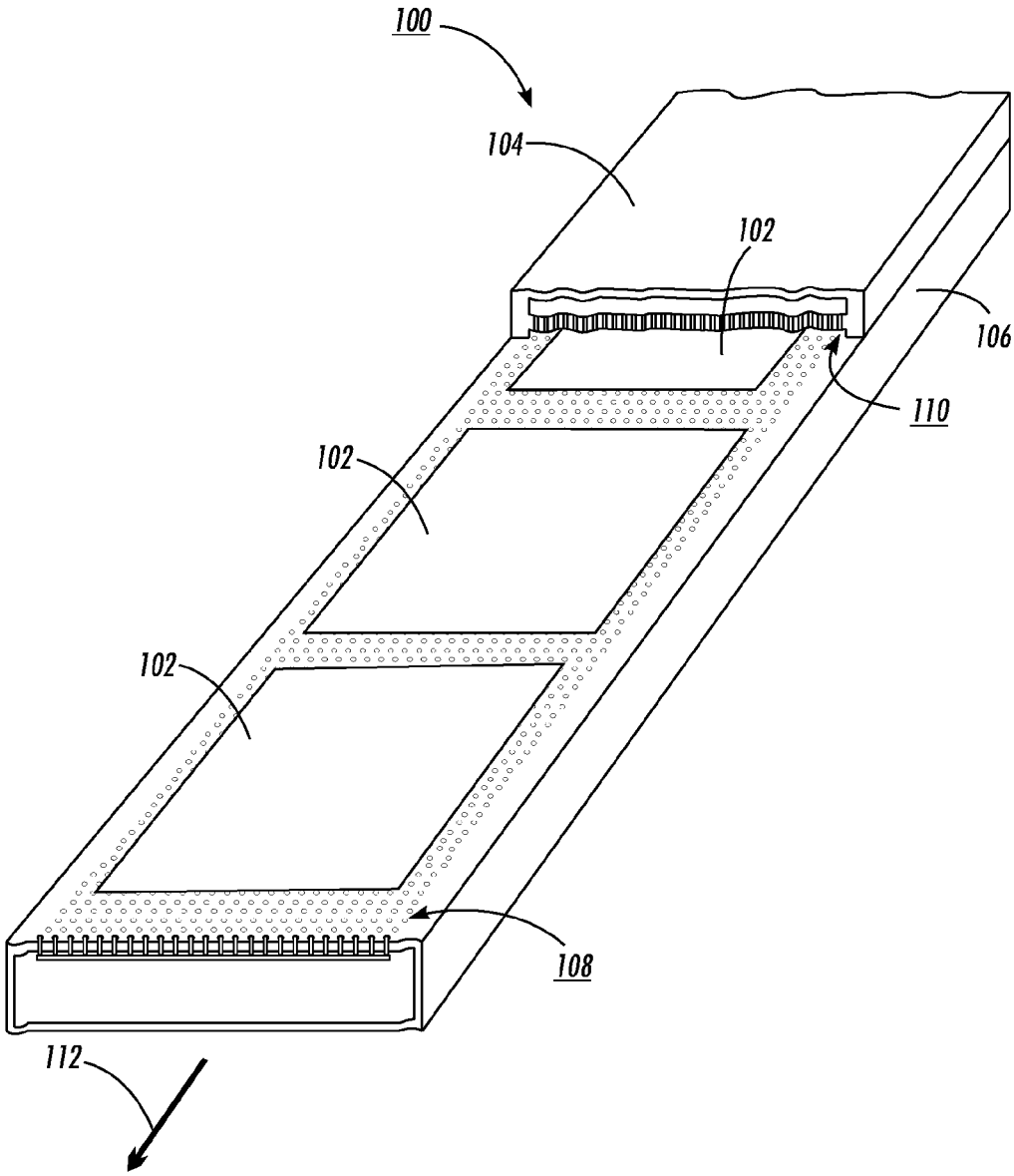
FIG. 1 illustrates a smart matter transport assembly for carrying out the present invention.

Referring now to the drawings where the showings are for the purpose of describing the invention and not for limiting same, FIG. 1 illustrates a transport assembly 100. The transport assembly 100, which is used to transport objects 102 in the process direction 112, is divided up into an upper section 104 and a lower section 106. For illustrative purposes part of the upper section 104 is cut away. Advantageously, the transport assembly 100 can transport a number of different types of materials such as paper, plastics, glass, foils, fabrics, uncured rubber and wafers. The sections 104 and 106 are sufficiently spaced apart to define a spacing 110 in which the object can travel along the transport assembly without contacting either the upper or lower sections 104 and 106. Embedded in both the upper and lower sections 104 and 106 are arrays of spatially fixed microelectromechanical devices 108 (MEMS) that dynamically support, move, and guide the objects 102 through the transport assembly 100. It will be understood by those skilled in the art that depending on the size, weight and flexibility of the object being transported and the speed and accuracy in which the object is required to be transported, the transport assembly may consist of only one of the upper section 104 or the lower section 106.

Figure 2:
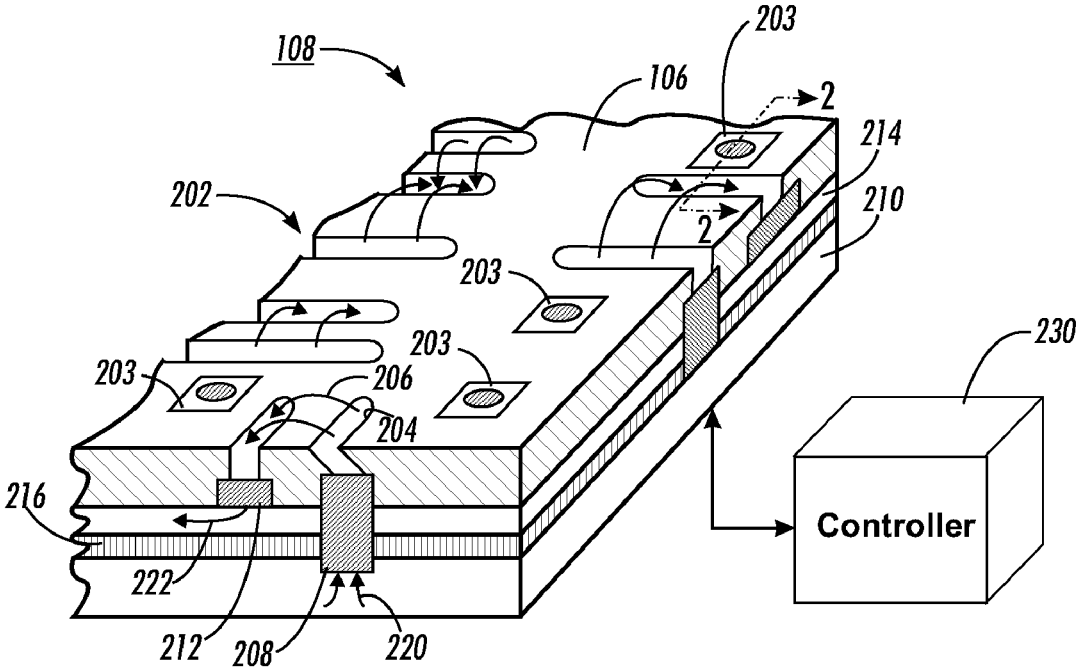
FIG. 2 illustrates a portion of the lower section of the transport assembly shown in FIG. 1.

FIG. 2 illustrates a portion of the lower section 106 of the transport assembly 100 shown in FIG. 1. More specifically, FIG. 2 illustrates a number of microelectromechanical devices 108 that consist of combinations of actuators 202, sensors 203, and controller(s) 230. In one embodiment, the actuators, sensors, and controller are fabricated together on a single silicon wafer. In another embodiment shown in FIG. 2, the sensors and actuators are fabricated in a housing separate from the controller 230. In the embodiment shown in FIG. 2, the actuators 202 are air jet actuators that include two or more channels 204. In another embodiment not shown the actuators 202 engage a mechanical drive coupled to rollers for transporting flexible objects such as paper.

More specifically in FIG. 2, the arrows indicated by reference number 206 illustrate the general movement of air exiting and entering the air jet channels 204. At least one of the channels of an air jet allows the exit of flowing air and the other of the channels the entrance of flowing air. It will be appreciated by those skilled in the art, however, that the air jet actuators may consist of a single channel which allows only the exit of air. A low-pressure plenum 214 is separated from high-pressure plenum 210 by a partition 216. The difference in pressure between low-pressure plenum 214 and high-pressure plenum 210 permits air to flow from one channel to another. For example, a valve 208 can be selectively operated to permit high-pressure air in plenum 210 to flow upward at an angle as indicated by arrows 220, to impart momentum to objects 102 on the transport assembly, and pass downward through valve 212 into plenum 214 as indicated by arrows 222.

Figure 3:
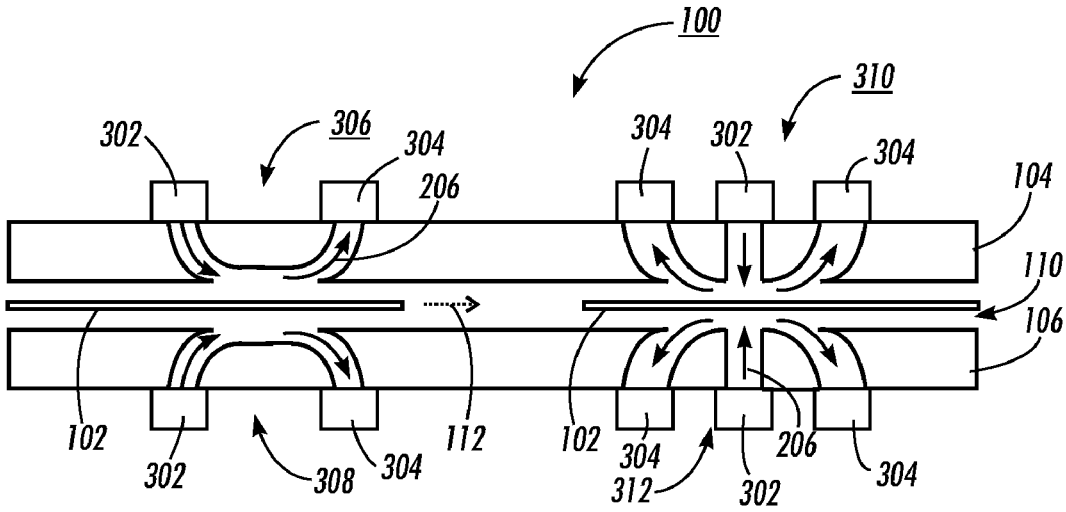
FIG. 3 illustrates two different types of air jets that are embedded in the transport assembly shown in FIG. 1.

FIG. 3 illustrates examples of two different types of air jet actuators 202 that are embedded in transport assembly shown in FIG. 1. As set forth above, the transport assembly 100 is divided into upper and lower sections 104 and 106 with the spacing or passageway 110 therebetween. A first type of air jet is indicated by reference numbers 306 and 308 and a second type of air jet by reference numbers 310 and 312. The two types of air jet actuators have valves 302 for releasing air from high-pressure plenum 212 and valves 304 receiving air into low-pressure plenum 214. The flow of air in FIG. 3 is indicated generally by arrows 206. Depending on the direction in which the air jet actuators 306 and 308 are positioned, air released therefrom will urge the object 102 in a selected process direction 112 and speed by adjusting the amount of air released onto either side of the object 102. In contrast, the air jet actuators 310 and 312 can be used to support the object 102 by applying an opposing vertically directed air flow as indicted by arrows from valves 302.

It will be appreciated by those skilled in the art that the first type of air jet actuators 306 and 308 may be positioned so that they exert a force opposite to that shown in the Figures in order to impart momentum to stop the object from moving in the process direction 112. In addition, it will be appreciated by those skilled in the art that two sets of the first type of air jet actuators 306 and 308 may be oriented to apply forces to rotate the object. For example, the object may be rotated by having a first set of air jet actuator, located on one side of the object, push in the process direction, while having a second set of air jet actuator, located on the other side of the object, push in a direction opposite to the process direction so that the combined effect of the two air jet actuators is to apply a torque to the object.

Figure 4:
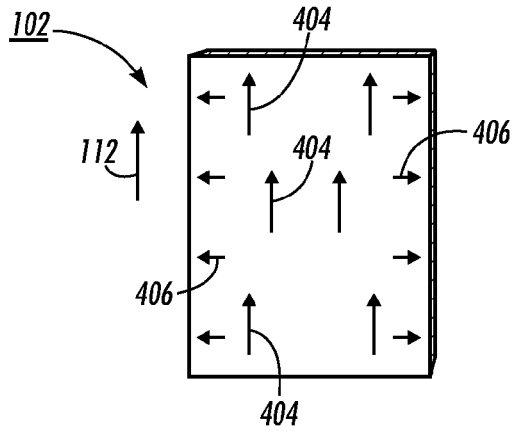
FIG. 4 illustrates one manner in which directional forces from air jets are applied to the object to control its movement along the transport assembly.

FIG. 4 illustrates one manner in which directional forces from air jet actuators 202 are applied to the object 102 to control its movement along transport assembly 100 in the process direction 112. Longitudinal forces, indicated by arrows 404, are applied to cause the object to move in the process direction 112. Lateral forces, indicated by arrows 406, are applied perpendicular to the direction of motion to stabilize the object 102. Vertical forces, not shown, help maintain the object 102 between the upper and lower sections 104 and 106 of the transport assembly 100. In FIG. 4, the relative strength of the forces 404 and 406 applied to the object 102 are illustrated by the length of the arrows 404 and 406. It will be appreciated by those skilled in the art that the accelerations resulting from these vertical, lateral, and longitudinal forces applied to an object will vary depending on the type of material and size of the object. Thus, for example, paper which is lighter and more flexible than glass may require smaller longitudinal forces but greater lateral forces to stabilize it on transport assembly 100 than a more rigid object such as glass.

Figure 5:
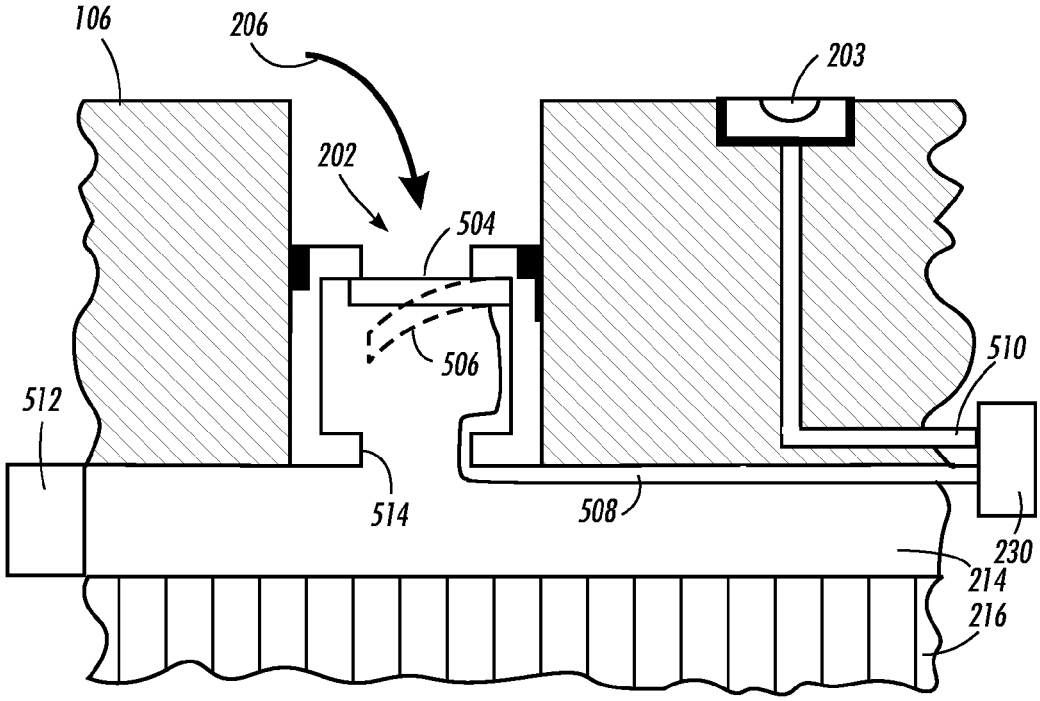
FIG. 5 illustrates a side view of an air jet, a sensor, and a controller as seen along view line 2-2 in FIG. 2.

FIG. 5 illustrates a side view of an air jet 202, sensor 203, and controller 230 as seen along view line 2-2 in FIG. 2. In the embodiment shown in FIG. 5, the air jet 202 is a piezoelectric flap valve. The flap valve is electrically controlled through lead 508 by controller 230 to be either in a closed position, indicated by reference number 504 (solid lines), or an open position, indicated by reference number 506 (dotted lines). The air jet 202 includes a housing 514 positioned in an aperture of the surface of lower section 106. In FIG. 5 the air moves inward because it is coupled to low-pressure plenum 214 as indicated by arrow 206. The pressure in the plenum is maintained by air pressure source 512. Sensor information from sensor 203 is received through lead 510 by controller 230. The sensor 203 in one embodiment is an optical sensor that is sufficiently accurate and quick to detect the object 102. In other embodiments, the sensor 203 is another type of contactless sensor such as a pressure sensor, acoustic sensor, or electrostatic sensor.

B. Distributed Control with Global Constraints

Figure 6:
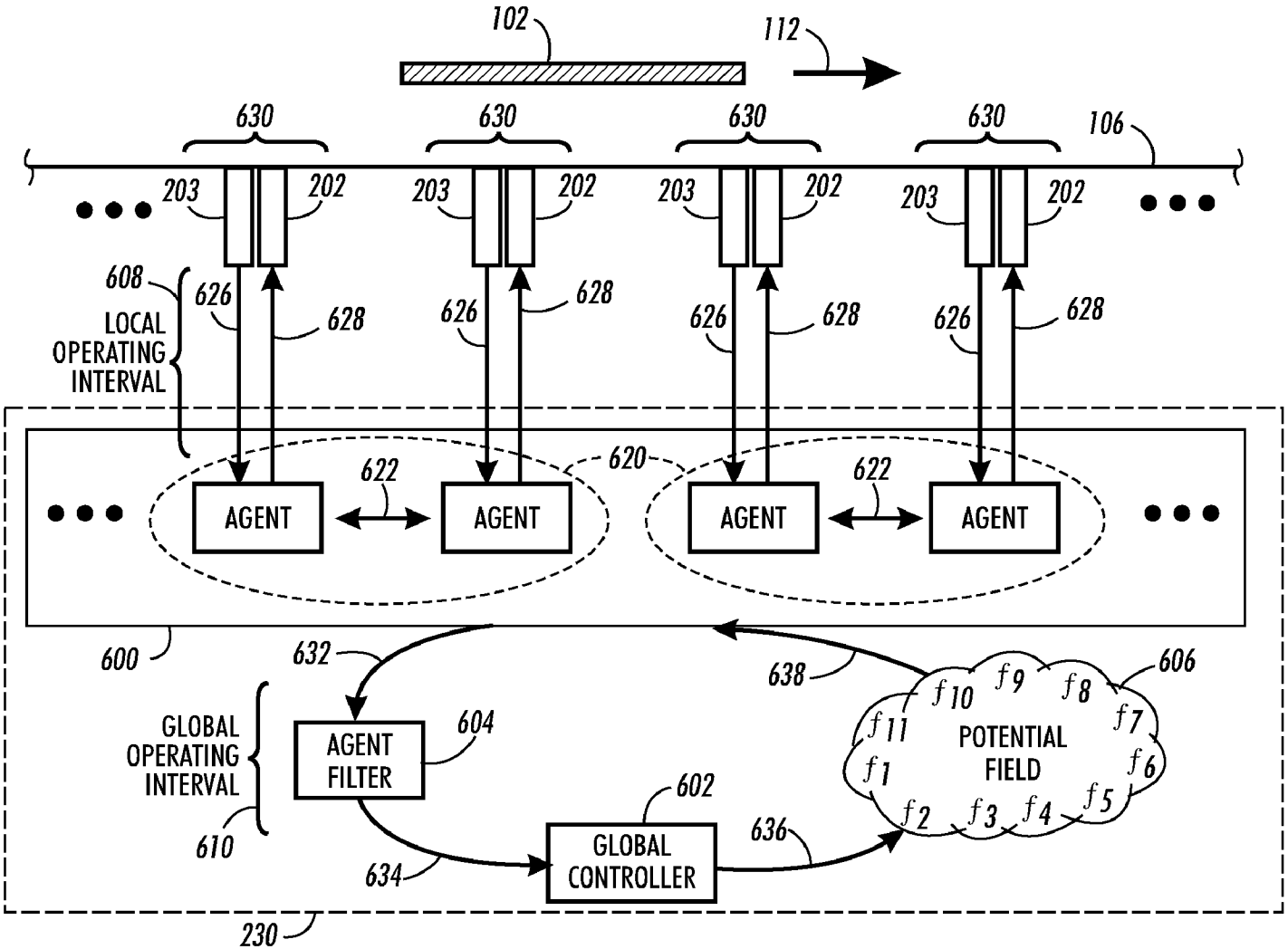
FIG. 6 illustrates a detailed block diagram of the controller shown in FIG. 2.

FIG. 6 illustrates a detailed block diagram of the controller 230 shown in FIG. 2. Using the embedded microscopic sensors 203 and actuators 202, the controller 230 actively controls the motion of objects 102 such as paper traveling between the upper and lower levels of the transport assembly. For illustrative purposes, only the lower level 106 of the transport assembly is shown in FIG. 6. Control of sensor 203 and actuators 202 embedded in the transport assembly 102 is distributed among local computational agents 600 (i.e., local controllers), each of which is concerned with a limited aspect of a system goal of moving object along the transport assembly. The agents are grouped into localized neighborhoods of agents 620, between which, desired actuator responses are directly communicated, as indicated by arrows 622. Each localized neighborhood of agents 620 is defined by sensors and actuators that are located physically proximate to each other on the transport assembly.

The agents 600 are coupled indirectly to a global controller 602 through an agent filter 604 and a potential field 606. The global controller 602 relies on simplified assumptions of an idealized system and limited aggregate operating characteristics of the transport assembly to produce an approximate specification of global constraint preferences. A simplified assumption of an idealized system is for example a system in which every sensor and actuator functions properly. The limited aggregate operating characteristics output from agent filter 604 is distilled from detailed sensor information output from agents 600. This approximate specification of global constraint preferences is delivered to the local agents through the potential field 606. As discussed in detail below, the local agents use the approximate specification of the global constraint preferences as well as detailed localized information to modify the behavior of actuators coupled thereto. The global constraint preferences provide a generalized guide to each agent of the system's behavior. In contrast, the localized information provides details of an agent's local operating environment (e.g., displacement of the object from the surface of the transport assembly). As a result, each agent is able to pursue a generalized system goal while compensating for localized deviations (e.g., perturbations of the object on the transport assembly, or localized sensor and actuator failures).

Advantageously, decomposition of the controller 230 into a global controller and local agents simplifies lines of communication between agents. This form of decomposition is appropriate for operating the controller 230 because interactions between local agents 600 tend to be limited to agents coupled to sensors and actuators located spatially proximate to each other. Unlike purely distributed systems in which agents communicate directly with each other, the controller 230 minimizes inter-agent communications by limiting the degree of information (i.e., quantity and specificity) exchanged by the global controller and the agents. As a result, agents with control sensors and actuators that are not located spatially proximate to each other, do not directly communicate with each other. Additionally, organizing the controller 230 into agents and a global controller has the advantage of simplifying the development of each in either hardware or software because each control element is concerned with a simplified aspect of the entire problem. The global controller is concerned with achieving an "idealized" global goal while each local agent is concerned with achieving a detailed localized goal.

More specifically, FIG. 6 illustrates a block diagram of a cross section of the lower section 106 of the transport assembly 100. Embedded at the surface of the lower section 106 are multiple sensors 202 and actuators 203. Agents 600 are coupled to the sensors and actuators to receive and transmit information therefrom. The sensors 203 transmit discrete measurements that correspond to the instantaneous position of the object 102 on the transport assembly to the agents 600, as indicated by arrows 626. The actuators or air jets 202 receive commands in the form of specific actuator settings from the agents 600, as indicated by arrows 628. Different actuator settings apply different directional forces in the form of air to the object 102 on the transport assembly. Although FIG. 6 shows each computational agent 604 coupled one sensor 203 and actuator 202, it will be appreciated by those skilled in the art that an actuator such as an air jet may include one or more channels of exiting or entering air and that a sensor may have one or more sensor elements. It will also be appreciated that each agent 600 can be coupled to one or more sensors and actuators to define a localized region of control 630. It will further be appreciated that the number of actuators need not equal the number of sensors in each localized region of control.

Unlike other distributed control organizations, there exits a high density of sensors and actuators embedded in the transport assembly. In one embodiment, the lower section of transport assembly 106 has on the order of 0.1-4 sensors and/or actuators per square centimeter. In addition, unlike other distributed control systems, the actuators are positioned sufficiently proximate to each other that their output may be cross-coupled. For example, output from two neighboring air jets may cumulatively apply a force that is different than the sum of the forces applied independently. In such a case, each local control agent requires some knowledge about its neighbors. To account for these cross-coupling effects, the agents 600 are organized into the local neighborhoods of agents 620 to minimize actuation effort required by each actuator to achieve the desired global system goal. The size of each neighborhood can either be fixed or defined adaptively and will depend on particular system in which they operate. Agents forming these local neighborhoods of agents 620 share their desired actuator response as indicated by arrow 622.

Each computational agent 600 is an autonomous controller. That is, each agent acts independent of any other agent and the global controller to ascertain how much force should be applied to its localized region of control. Data from its localized region of control 630, desired actuator responses from its local neighborhoods of agents 620, and values detected from the potential field 606 are used by an agent to calculate a desired actuator response that is based upon a desired state and a current state of the object's position and velocity. Each agent responds to environmental changes that sensor and actuator pairs detect within a local operating time interval 608 that is on the order of 1-100 milliseconds. During each local operating time interval, multiple agents operate to stabilize and propel one or more objects along the transport assembly. In the case of the transport assembly 100 shown in the Figures, sensors 203 and air jets 202 must be able to quickly ascertain the amount of force to apply to each object or paper 102 on the transport assembly within the local operating time interval to precisely move the object along the transport assembly. This organization of distributed control provides real time responses to local environmental changes detected along the transport assembly because the agents have autonomous control over the actuators to which they are coupled.

The global controller 602 communicates with the agents over a global operating time interval 610. The global operating time interval 610 is slower by, for example, one or more orders of magnitude than the local operating time interval 608. The reason for the difference is that the computational operations performed by the global controller 602 are more complex than the local agents 600. Unlike the local agents which are concerned with only localized regions of control 630, the global controller evaluates generalized positional and directional information of objects on the transport assembly to determine whether the system goal is being achieved. Consequently, the global controller is history-sensitive and must maintain detailed state information while the local agents maintain little or no state information. In one embodiment, the system goal, which defines the global constraint preferences, may be specified using a desired trajectory of the object on the transport assembly. In one instance, the desired trajectory defines how the object moves on the transport assembly as a function of time. To simplify the computational task of the global controller 602, detailed sensor information transmitted from agents 600, as indicated by arrow 632, is filtered by agent filter 604. The agent filter 604 averages detailed sensor information over the global operating interval 610. As a result, the global controller 602 senses aggregate (or generalized) operating characteristics and not detailed characteristics of the entire configuration of local agents 600.

The global controller 602 computes an approximate specification of global constraint preferences using the generalized positional and directional information from filter agent 604 to generate a potential field 606. The computed global constraint preferences are delivered to agents 600 through the potential field 606, as indicated by arrow 638. The magnitude of the potential field varies depending on the particular location of the transport assembly the agents are mapped or physically located. Advantageously, the potential field simplifies communication between the global controller and the assembly of agents 600 because the global controller does not have to communicate directly with any one agent but instead delivers information generally to all agents.

In one embodiment, the potential field 606 is a set of values $f_1$, $f_2$, $f_3$, etc. that map to locations where the agents 600 or their sensors and actuators are located. In an alternate embodiment, the range of values is substituted with a set of difference values (e.g., $f_1-f_2$). The range of values and the range of differences values change gradually from one value to the next. This gradual change minimizes abrupt transitions in global specification of constraint preferences, thereby allowing simpler global control based on limited aggregate operating characteristics. Local forces, however, could change abruptly due to actuator or sensor failures, for example. In yet another embodiment, a limited number of regions of the potential field are defined to have values, and any value in any intervening region is interpolated by the agents. Depending on where an agent is located, or mapped, the potential field defines what value the agent detects. For example, the agents shown in FIG. 6 detect a value of $f_{11}$ for the potential field 606 as indicated by arrow 638. In one embodiment, agents in similarly situated neighborhoods 620 are mapped to a region of the potential field having a similar value (e.g., $f_1$). Alternatively, each agent is mapped to a unique region of the potential field that is independent from any other agent.

The value of the potential field 606 detected by an agent relates to the system's global constraint preferences for a generalized region of the transport assembly. These global constraint preferences provide instructions that define how an agent should behave generally. In one embodiment, the potential field values are constant and therefore only communicate the system's global constraints once at system initialization. In another embodiment, the potential field values are updated over the global operating interval 610. In this alternate embodiment, aggregate operating characteristics received from agent filter 604 are evaluated by global controller 602 using simplified assumptions of the operation of the transport assembly before updating the values of the potential field 606 over the global operating time interval 610.

The potential field 606 can be specified using either mechanical or electrical forces. For example in the transport assembly, each agent could detect values of global constraint preferences from a wire carrying a range of voltage potentials. Alternatively, each agent could detect regional air pressure settings of the transport assembly. In this alternate embodiment, values of the global constraints are reflected regionally by the pressure difference between low-pressure plenum 214 and high-pressure plenum 216. In another embodiment, global constraints could be conveyed using funding policies of computational markets. More details of computational markets are disclosed in U.S. Pat. No. 6,119,052. In yet another embodiment probabilistic and randomized algorithms are used to define local agent behavior, and in which global constraints are conveyed using probability values that are delivered to the collection of agents. In a further embodiment, the global controller delivers the values of the potential field digitally using a broadcast network or a shared memory storing a lookup table.

Figure 7:
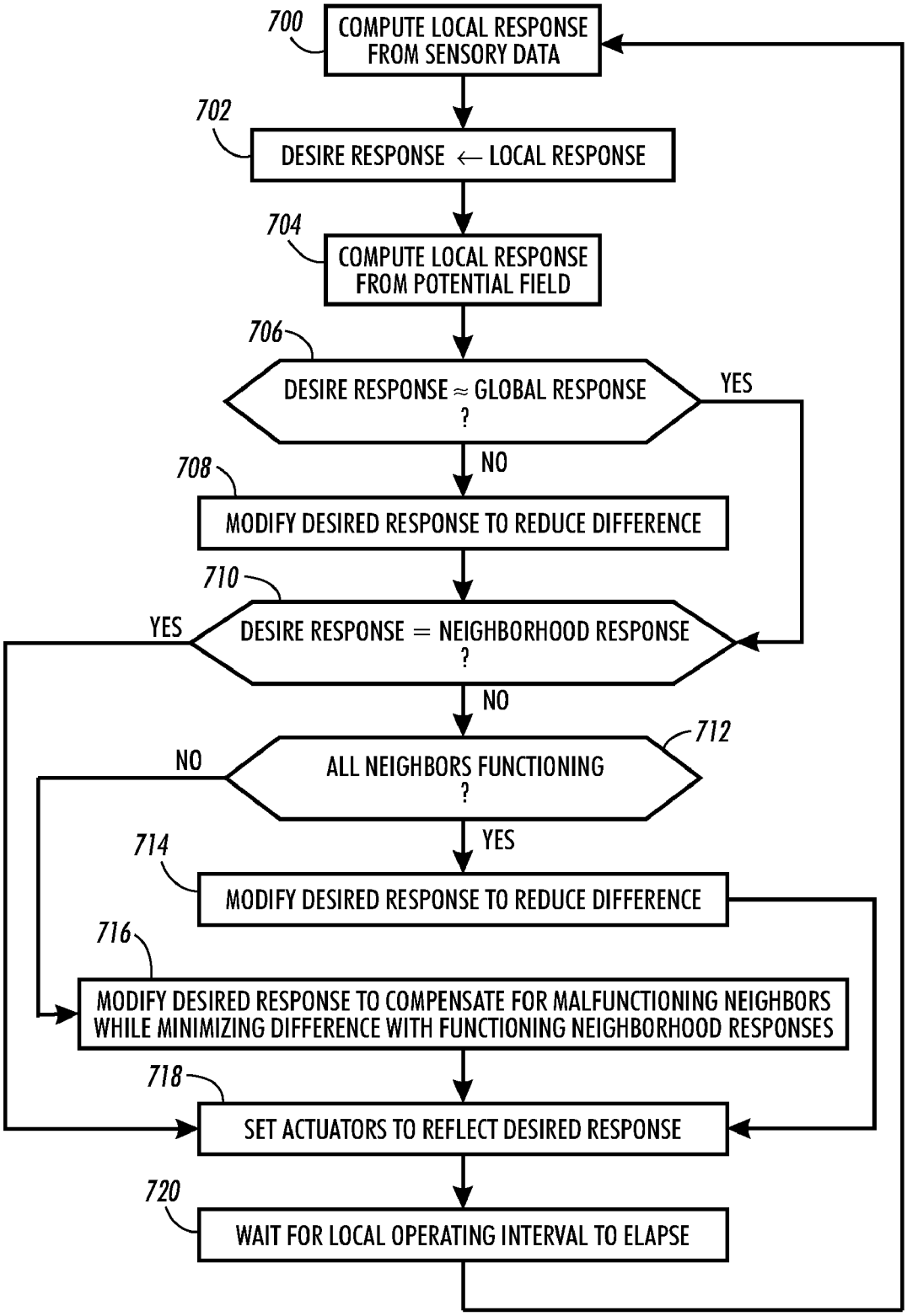
FIG. 7 is a flow diagram which sets forth the steps performed by an agent during a local operating time interval.

FIG. 7 is a flow diagram which sets forth the steps performed by an agent during the local operating time interval 608. At step 700, the agent computes a local response to sensor information received from sensors to which it is coupled. At step 702, the local response is assigned to equal a desired response. The desired response is the desired correctional command sought to be issued to the actuator units to which the agent is coupled. At step 704, an agent detects a value of the potential field 606. The values of the potential field can be fixed at the time system variables of the transport assembly are initialized at start up. Alternatively, the values of the global field can be adaptively modified as set forth in U.S. Pat. No. 6,027,112.

Using this detected value of the potential field 606, the agent computes a global response at step 704. As set forth above, the magnitude of the potential field varies depending on the particular location of the transport assembly the agents are mapped or physically located. By detecting the magnitude of the potential field, an agent can ascertain a generalized goal of the global controller in its particular region of the transport assembly. The generalized goal may, for example, be to move an object along the transport assembly at a particular velocity. Each operating actuator contributes to achieving this goal. The global controller receives aggregate operating characteristics of the transport assembly, but not the status of each actuator. That is, the global controller is unaware of how much each agent is contributing to achieving the generalized goal.

At step 706, the agent tests whether the desired response (i.e., local response at this point) is approximately equal to the global response computed at step 704. In the event the global response is approximately equal to the desired response, then step 710 is performed; otherwise, step 708 is performed to reduce deviations from the approximate global control model of the system. At step 708, the desired response is modified to reduce the difference between the local response and the global response. Subsequently, at step 710, the desired response (whether modified or unmodified) is tested to determine whether it is approximately equal to local neighborhood responses. That is, at step 710, the agent compares its desired response with that of other agents in its localized neighborhood 620. If actuators and sensors coupled to neighborhood agents are all properly functioning, then step 714 is performed; otherwise, step 716 is performed to reduce deviations from desired responses in the localized neighborhood 620. At step 714, the desired response is modified to reduce the difference between it and the neighborhood response. Otherwise at step 716, the desired response is modified to compensate for malfunctioning neighbors while minimizing the difference between the modified desired response and the neighborhood responses.

At step 718, the set of actuators to which the agent is coupled is adjusted to reflect the desired response. The actuators controlled by each agent may be adjusted to one or more different settings. In the transport assembly 100 each setting could reflect different settings of the air valves (e.g., closed, ¼ open, ½ open, ¾ open, and full open). At step 720, the agent waits for the local operating interval 608 to elapse before repeating step 700. In operation, the controller 230 repeats these steps each time local sensor information is received by an agent, thereby creating a feedback loop in which localized positional information is received and a correctional command is issued over each local operating time interval 608. However, since the global operating interval may be one or more orders of magnitude slower than the local operating interval, the rate at which the potential field is updated depends on the global operating time interval 610. As a result, several iterations of step 904 may be performed before the potential field is changed by the global controller 602.

Figure 8:
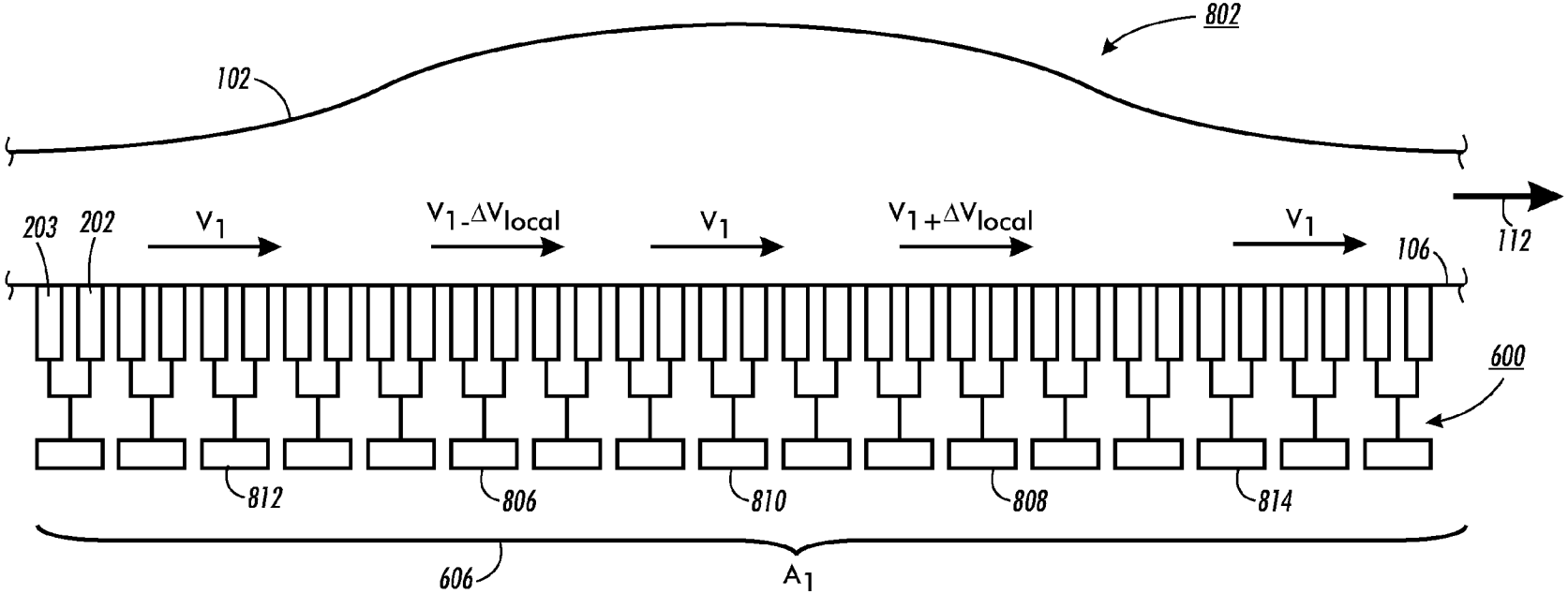
FIG. 8 illustrates an example of how the localized neighborhood of agents compensate for a perturbation in the object independent from the global controller.
Figure 9:
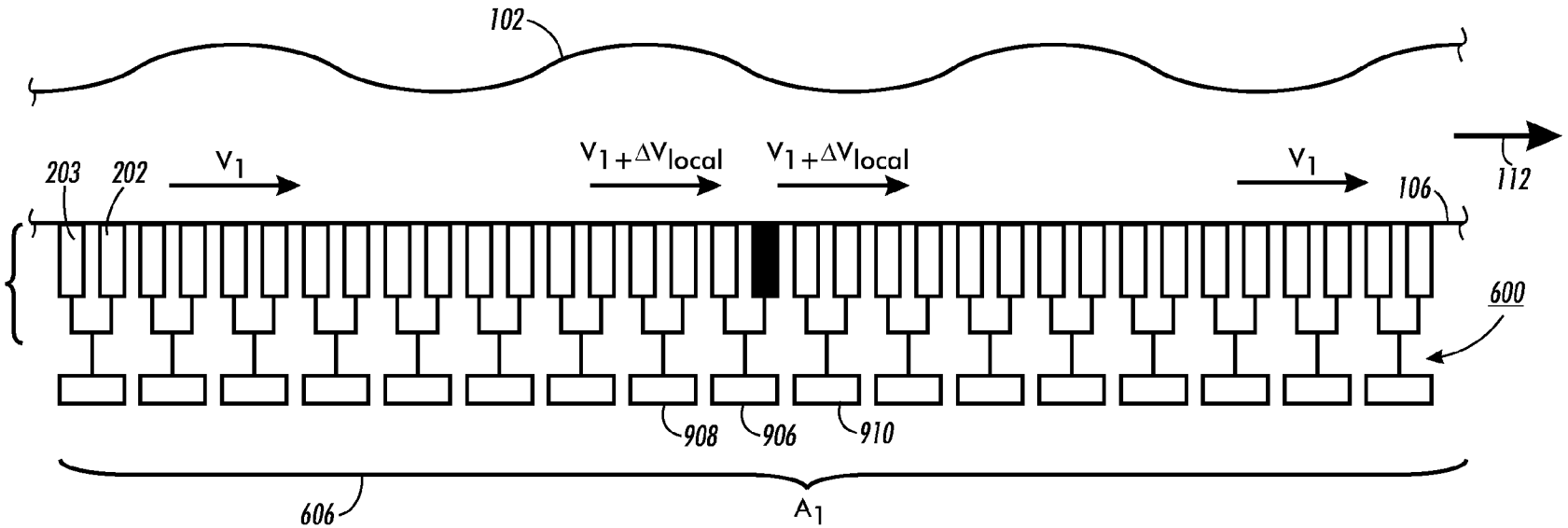
FIG. 9 illustrates an example in which agents compensate for malfunctioning actuators in a localized neighborhood.

FIGS. 8 and 9 illustrate cross sections of the lower section 106 of the transport assembly. Each Figure illustrates a different example of the controller 230 in operation. In both FIGS. 8 and 9, the agents 600 grouped in the localized neighborhood of agents $A_1$ work to achieve a global system goal, defined generally by potential field 606, of moving the object 102 at velocity $v_1$ along the lower level of the transport assembly. The velocity $v_1$ is determined by looking up the local neighborhood of agents $A_1$ to which it was mapped in lookup table 1000 illustrated in FIG. 10. After each agent determines a global goal from the potential field, each agent computes its desired local goal $v_{local}$. A resulting velocity $v_{agent}$, which is the desired actuation force to be applied by the actuators coupled thereto, is defined generally as a function of both the global velocity $v_{global}$ and the local velocity $v_{local}$. The resulting velocity $v_{agent}$ of an agent can be represented in one embodiment as a linear combination of the global actuator response (e.g., velocity $v_{global}$) and the local actuator response (e.g., velocity $v_{local}$), as illustrated by the following equation:

$$v_{agent}=w_1v_{global}+w_2v_{local}, \text{ where}$$

weights $w_1$ and $w_2$ define how much value to assign the global response and the local response. These weight can either be fixed or adaptively determined. In the examples illustrated in FIGS. 9 and 10, the local velocity $v_{local}$ is defined as difference velocity $\Delta v_{local}$, which can have a positive or a negative value. The resulting velocity $v_{agent}$ in this example can therefore be represented by the following equation:

$$v_{agent}=v_{global}+\Delta v_{local}.$$

More specifically, FIG. 8 illustrates an example of how the localized neighborhood of agents 620 compensate for a perturbation 802 in the object 102 independent from the global controller 602. Because the global controller only detects the aggregate operating characteristics of the transport assembly, the global controller does not detect detailed localized behavior. In accordance with the invention, the individual agents 600 compensate for the perturbation 802 by modifying the system goal of the global controller. As illustrated in FIG. 8, agent 806 reduces the global goal with a local change in velocity $\Delta v_{local}$ to move the object at a resulting velocity $v_{agent}$ given by $v_1-\Delta v_{local}$. In addition, agent 808 modifies the system goal to speed the object 102 up by changing the global goal to move the object at a resulting velocity $v_{agent}$ given by $v_1+\Delta v_{local}$. It will be appreciated by those skilled in the art that the resulting agent velocity $v_{agent}$ will generally increase from $v_1-\Delta v_{local}$ at agent 806 to $v_1$ at agent 812 and from $v_1-\Delta v_{local}$ at agent 806 to $v_1$ agent 810, and that the resulting velocity $v_{agent}$ will generally decrease from $v_1+\Delta v_{local}$ at agent 808 to $v_1$ at agent 810 and from $v_1+\Delta v_{local}$ at agent 808 to $v_1$ at agent 814. These localized changes in velocity which are made independent of the global controller have the overall effect of smoothing out the perturbation 802.

FIG. 9 illustrates an example in which agents 600 that compensate for malfunctioning actuators in a localized neighborhood. In FIG. 9, actuator 202 of agent 906 is not operating. Consequently, agents 908 and 910 compensate for this loss of force by changing the global goal to move the object at a resulting velocity $v_{agent}$ given by $v_1+\Delta v_{local}$, thereby producing a force that approximates the global goal in a localized region of the transport assembly. The localized changes by agents 908 and 910 effectively mask localized failures from the global controller 602, thereby simplifying the functionality of the global controller. This example illustrates how the local agents make the actuators and sensors behave closer to the generalized set of global constraints relied upon by the global controller in developing the potential field. In effect, the controller 230 operates with local agents having only detailed information of behavior of other agents within their local neighborhood and the global controller having only an aggregate or blurry perspective of agent behavior.

C. Summary

The invention has been described with reference to a particular embodiment. Modifications and alterations will occur to others upon reading and understanding this specification taken together with the drawings. The embodiments are but examples, and various alternatives, modifications, variations or improvements may be made by those skilled in the art from this teaching which are intended to be encompassed by the following claims.

While the present invention has been illustrated using a two level controller 230, it will be appreciated by those skilled in the art that the two level controller can be generalized to multiple levels. For example, the agents 600 could be grouped into multi-hierarchical levels of control to define regions of control as described in detail in U.S. Pat. No. 6,039,316. Alternatively, multiple controllers 230 could be grouped into multi-hierarchical levels of control. It will also be appreciated that the controller 230 as defined herein can be used to stabilize materials as set forth in U.S. Pat. No. 6,119,052 or U.S. Pat. No. 6,027,112. In this alternate embodiment, the global controller changes the potential field to encourage agents to compensate for parts of the structure that are under stress.

It will be appreciated that the controller 230 may be readily implemented in software using software development environments that provide portable source code that can be used on a variety of hardware platforms. Alternatively, the disclosed system may be implemented partially or fully in hardware using standard logic circuits. Whether software or hardware is used to implement the system varies depending on the speed and efficiency requirements of the system and also the particular function and the particular software or hardware systems and the particular microprocessor or microcomputer systems being utilized.

In addition, the controller 230 may either be a physically distributed system in which each agent is operating on a separate processing unit. Alternatively, the controller may be implemented in a memory of a centralized processing unit having one or more processors. Because each agent does not have to be cognizant of whether it is operating on a physically distributed or centralized system, the software for implementing the controller can be implemented to run in either environment. In either embodiment, the system can be readily developed by those skilled in the applicable arts without undue experimentation from the functional description provided herein together with a general knowledge of the computer arts.

It will be appreciated by those skilled in the art that actuators 202 can be used to move an object along the transport assembly with fluids other than air. Also, will also be appreciated by those skilled in the art that the controller 230 can be used to control other types of pneumatic actuators such as vacuum actuators. In addition, it will be appreciated that the controller can be used to control mechanical actuators. For example, controller 230 can be used to control mechanical rollers or a vacuum belt to move sheets of paper in an electronic printing machine. In another embodiment, not shown, the agents are coupled to sensor units that are physically offset from actuator units on the transport assembly. In this alternate embodiment, the agents are coupled to sensor units and actuator units which are not co-located immediately adjacent to each other.

A more detailed description of the sensors and actuators forming a transport assembly is disclosed in U.S. Pat. No. 5,634,636, which is incorporated herein by reference. For additional details, examples and background on smart matter, the following article is incorporated herein by reference: Carlson et al., "Controlling Agents in Smart Matter with Global Constraints," Proc. of the AAAI97 Workshop on Constraints and Agents, pp. 58-63, July 1997 (also on the internet at http://ic-www.arc.nasa.gov/ic/people/vgupta/publications/smartmatter-aaai97.ps).

The invention claimed is:

1. A transport assembly for moving an object, comprising:

sensor units and actuator units arranged on the transport assembly; said sensor units for providing positional information of the object; said actuator units for moving the object relative to the transport assembly;

computational agents coupled said sensor units and said actuator units; each computational agent receiving positional information from at least one sensor unit and computing a desired actuator response for at least one actuator unit in a spatially localized region of control on the transport assembly; and a global controller, coupled to said computational agents, for receiving aggregate operating characteristics from, and delivering global constraints to, said computational agents;

wherein said computational agents are grouped into a plurality of local neighborhoods; a plurality of computational agents in each local neighborhood being: (a) coupled to sensors and actuators that are located physically proximate to each other on the transport assembly; and (b) communicatively coupled to each other for directly communicating their desired actuator responses to each other; and wherein each of said computational agents use (i) the global constraints delivered by the global controller, (ii) the desired actuator responses received from the computational agents in their local neighborhood, and (iii) the positional information from the at least one sensor unit in its spatially localized region of control, to determine adjustments to the at least one actuator unit in its spatially localized region of control to move the object along the transport assembly.

2. The transport assembly according to claim 1, further comprising a lookup table for communicating the global constraints to said computational agents.

3. The transport assembly according to claim 1, further comprising a filter unit for computing the aggregate operating characteristics after receiving the positional information from the computational units.

4. The transport assembly according to claim 1, wherein said global controller receives the aggregate operating characteristics over a first operating interval.

5. The transport assembly according to claim 4, wherein said global controller delivers the global constraints over a second operating interval.

6. The transport assembly according to claim 5, wherein the second operating interval is longer than the first operating interval.

7. The transport assembly according to claim 1, wherein sizes of the local neighborhoods of computational agents is determined adaptively.

8. The transport assembly according to claim 1, wherein sizes of the local neighborhoods of computational agents are fixed.

9. The transport assembly according to claim 1, wherein said computational agents compute a global response using the global constraints.

10. The transport assembly according to claim 9, wherein each computational agent computes the desired actuator response using the positional information from the at least one sensor unit in its spatially localized region of control on the transport assembly.

11. The transport assembly according to claim 10, wherein said computational agents determine whether spatially localized groupings of sensor and actuator units function properly.

12. The transport assembly according to claim 1, wherein said computational agents rank the global response and the desired actuator response in importance using weights.

13. The transport assembly according to claim 12, wherein said computational agents adaptively determine values for the weights.

14. The transport assembly according to claim 1, wherein said computational agents and said global controller are organized hierarchically.

15. In a transport assembly having sensors, actuators and a controller, the controller having computational agents and a global controller for controlling movement of an object on the transport assembly, a method for operating each of the computational agents, comprising the steps of:

receiving positional information from at least one sensor in a spatially localized region of control on the transport assembly;

computing a desired actuator response for at least one actuator in its spatially localized region of control on the transport assembly;

computing a global actuator response for detected global constraints from the global controller;

receiving desired actuator responses from other computational agents in a local neighborhood of computational agents to which it is grouped; the computational agents grouped in each local neighborhood being coupled to sensors and actuators that are located physically proximate to each other on the transport assembly;

computing an actuator response using (i) the computed local actuator response received from computational agents in its local neighborhood of computational agents, (ii) the positional information from the at least one sensor in its spatially localized region of control, and (iii) the computed global actuator response; and applying the actuator response to the at least one actuator in its spatially localized region of control on the transport assembly.

16. The method according to claim 15, wherein the computed actuator response compensates for malfunctioning actuators.

17. The method according to claim 16, wherein the desired actuator response is computed using accumulated positional information from the at least one sensor in its spatially localized region of control on the transport assembly.

18. The method according to claim 15, wherein the size of the local neighborhoods of computational agents is determined adaptively.

19. The method according to claim 16, further comprising the step of determining whether spatially localized groupings of sensors and actuators function properly.

20. The method according to claim 16, wherein said step of computing a desired actuator response further comprises the step of retrieving the global constraints from a lookup table.

* * * * *